US006475583B1

(12) United States Patent
Hsu

(10) Patent No.: US 6,475,583 B1
(45) Date of Patent: Nov. 5, 2002

(54) STRUCTURE OF TUBULAR PRODUCT OF FIBER COMPOSITE MATERIAL

(76) Inventor: Patrick Hsu, No. 132, Chung Yi Street, Taichung City (TW)

( * ) Notice: Subject to any disclaimer, the term of this patent is extended or adjusted under 35 U.S.C. 154(b) by 102 days.

(21) Appl. No.: 09/588,596

(22) Filed: Jun. 7, 2000

(51) Int. Cl.[7] ..... B29D 22/00

(52) U.S. Cl. ..... 428/36.9; 428/34.5; 428/34.7; 428/36.2

(58) Field of Search ..... 428/34.5, 34.7, 428/36.2, 36.9

(56) References Cited

U.S. PATENT DOCUMENTS 5,437,450 A * 8/1995 Akatsuka et al. ..... 273/80

5,904,627 A * 5/1999 Miyaji et al. ..... 473/319

FOREIGN PATENT DOCUMENTS

JP 07067992 * 3/1995 ..... A63B/53/10

* cited by examiner

*Primary Examiner*—Mark L. Bell
*Assistant Examiner*—Shalie Manlove
(74) *Attorney, Agent, or Firm*—Browdy and Neimark, P.L.L.C.

(57) ABSTRACT

A tubular product is made of a fiber composite material and is composed of an inner layer and an outer layer. The inner layer is formed of a fiber tow by the filament winding method, whereas the outer layer is formed of one or more fiber sheets by the sheet rolling method. By virtue of the inner layer, the tubular product has a uniform rigidity. The outer layer serves to reinforce the flexural strength of the tubular product.

7 Claims, 1 Drawing Sheet

STRUCTURE OF TUBULAR PRODUCT OF FIBER COMPOSITE MATERIAL

FIELD OF THE INVENTION

The present invention relates generally to a tubular product, and more particularly to a tubular product made of a fiber composite material.

BACKGROUND OF THE INVENTION

The conventional tubular products, such as golf club, fishing rod, ski pole, etc., are generally made of a fiber composite material by the sheet rolling method or filament winding method. The sheet rolling method involves the use of a plurality of fiber sheets which are preimpregnated with resin and are rolled around a core shaft such that the fiber orientation of the fiber sheets forms a predetermined angle with the longitudinal direction of the core shaft. The fiber sheets and the core shaft are heated and then cooled. A tubular product is finally formed by withdrawing the core shaft. In light of some fibers being parallel to the longitudinal direction of the core shaft, the tubular product has a greater resistance to flexure. However, such a tubular product has a rigid spine that is formed at the junction of the ends of the fiber sheets. In addition, certain fiber sheets are wound irregularly. As a result, the tubular product so made is apt to have the uneven rigidity throughout the tubular product. The filament winding method involves the winding of the fiber tows on a core shaft in a spiral manner. The core shaft and the fiber tows are heated and then cooled to take shape. A tubular product is formed upon the withdrawal of the core shaft. The winding of the fiber tows on the core shaft is done with precision by a computer-aided technique. As a result, the tubular product has a uniformity in terms of physical property. However, the tubular product is relatively less resistant to flexure in view of the fibers forming with the longitudinal direction of the core shaft an angle ranging between 30 and 45 degrees. In other words, the fibers can not be so arranged that they are parallel to the longitudinal direction of the core shaft.

SUMMARY OF THE INVENTION

The primary objective of the present invention is to provide a tubular product which is greater in flexural strength than the tubular product made by the conventional filament winding method. The tubular product of the present invention has an appropriate weight and a tube wall of an appropriate thickness.

The tubular product of the present invention is formed of an inner layer and an outer layer. The inner layer is formed of a fiber tow by the filament winding method and is encircled entirely or partially by the outer layer which is formed of one or more of the fiber sheets by the sheet rolling method. The fiber orientation of the outer layer of fiber sheets can form a predetermined angle with the longitudinal direction of the tubular product. Preferably, the fiber orientation of at least one fiber sheet of the outer layer is parallel to the longitudinal direction of the tubular product.

DETAILED DESCRIPTION OF THE INVENTION

Figure 1:
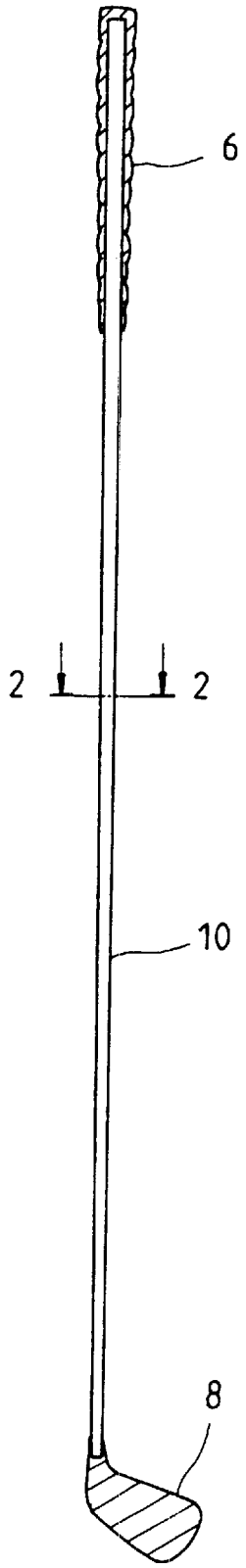
FIG. 1 shows a perspective view of a tubular product of a preferred embodiment of the present invention.

As shown in FIG. 1, a tubular product 10 embodied in the present invention is a golf club having a grip 6 and a head 8. The tubular product 10 is thus tapered.

Figure 2:
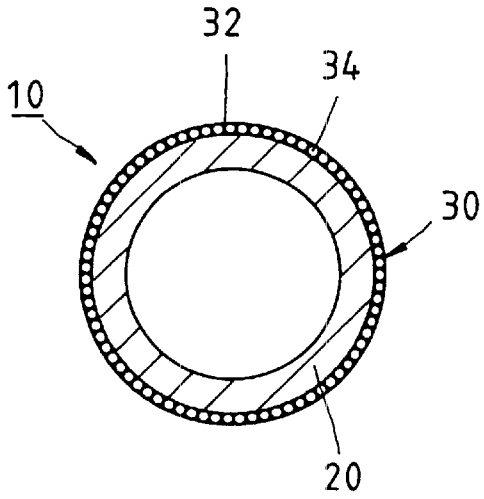
FIG. 2 shows a cross-sectional view of a portion taken along the direction indicated by a line 2—2 as shown in FIG. 1.

As shown in FIG. 2, the tubular product 10 is formed of an inner layer 20 and an outer layer 30. The inner layer 20 is a conical tube equal in length to the tubular product 10 and is made of a fiber tow of a fiber composite material by the filament winding method. The fiber composite material may be a carbon fiber, glass fiber, or boron fiber. The outer layer 30 is made of one or more fiber sheets 32 by the sheet rolling method such that the orientation of all fibers 34 of the fiber sheet 32 are parallel the longitudinal direction of the tubular product 10. The fiber 34 may be the carbon fiber, the glass fiber, or the boron fiber. The fiber sheet 32 is preimpregnated with epoxy resin before the fiber sheet 32 is rolled over the hardened inner layer 20. If the outer layer 30 is formed of a plurality of fiber sheets 32, it is suggested that the orientation of the fiber of the outermost fiber sheet is parallel to the longitudinal direction of the tubular product, and that the orientations of the fibers of the remainder of the fiber sheets form an angle of 45 degrees with the longitudinal direction of the tubular product. In addition, the inner layer 20 may be encircled fully or partially by the outer layer 30.

In light of the inner layer 20 being made by the filament winding method, the tubular product 10 of the present invention is uniformly rigid. In the meantime, the tubular product 10 of the present invention is relatively greater in flexural strength than a comparable tubular product of the prior art by virtue of the fact that the fiber orientation of at least one of the fiber sheets of the outer layer 30 is parallel to the longitudinal direction of the tubular product 10.

What is claimed is:

1. A tubular product of a fiber composite material, said tubular product comprising an inner layer and an outer layer encircling said inner layer, said inner layer being formed of a fiber tow by a filament winding method, said outer layer being formed of one or more fiber sheets by a sheet rolling method wherein an orientation of all fibers of at least one of said fiber sheets are parallel with a longitudinal axis of said inner layer.

2. The tubular product as defined in claim 1, wherein an orientation of fibers of at least one of said fiber sheets form a predetermined angle to the longitudinal axis of said inner layer.

3. The tubular product as defined in claim 2, wherein the sheet of the sheets which has all fibers thereof parallel to the longitudinal axis of the inner layer is an outermost sheet of the outer layer.

4. The tubular product as defined in claim 1, wherein the outer layer is preimpregnated with epoxy resin before being applied over the inner layer which has been hardened.

5. The tubular product as defined in claim 1, wherein fiber orientation of an outermost fiber sheet is parallel to the longitudinal axis of said inner layer and fiber orientation of a remainder of said fiber sheets forming an angle of 45 degrees with the longitudinal axis of said inner layer.

6. The tubular product as defined in claim 1, wherein said inner layer is fully enclosed by said outer layer.

7. The tubular product as defined in claim 6, wherein said inner layer is partially enclosed by said outer layer.

* * * * *